US011828577B2

(12) United States Patent
Steele et al.

(10) Patent No.: US 11,828,577 B2
(45) Date of Patent: Nov. 28, 2023

(54) BATTERING RAM WITH CANISTER DEPLOYMENT

(71) Applicants: Burton Douglas Steele, Regina (CA); Ian Cook, Regina (CA)

(72) Inventors: Burton Douglas Steele, Regina (CA); Ian Cook, Regina (CA)

( * ) Notice: Subject to any disclaimer, the term of this patent is extended or adjusted under 35 U.S.C. 154(b) by 0 days.

(21) Appl. No.: 17/729,762

(22) Filed: Apr. 26, 2022

(65) Prior Publication Data

US 2022/0357134 A1 Nov. 10, 2022

(30) Foreign Application Priority Data

May 5, 2021 (CA) ..... CA 3117280

(51) Int. Cl.

| | |
|---|---|
| ***F41H 9/00*** | (2006.01) |
| ***F41H 9/04*** | (2006.01) |
| ***F41H 7/00*** | (2006.01) |
| ***F41B 15/00*** | (2006.01) |

(52) U.S. Cl.

CPC ..... *F41H 9/04* (2013.01); *F41B 15/00* (2013.01); *F41H 7/00* (2013.01)

(58) Field of Classification Search

CPC ..... A62C 31/22; A62C 19/00; A62C 3/025; F42B 12/46; F42B 27/08; F42B 33/06; F41A 27/10; F41H 9/10; F41H 9/04; F41H 7/00; F41B 15/00; B05B 1/02; B05B 1/14

USPC ..... 222/192; 239/271; 42/1.08; 102/367, 102/368, 370; 169/52, 70; 89/131

See application file for complete search history.

(56) References Cited

U.S. PATENT DOCUMENTS 2,491,516 A * 12/1949 Piggot ..... F42B 33/06 134/5
2,813,753 A * 11/1957 Roberts ..... B05B 1/14 239/DIG. 13
3,530,580 A * 9/1970 Thomas ..... F41H 9/10 102/512
3,833,064 A * 9/1974 Ranney, Jr. ..... A62C 3/025 169/36
4,046,055 A * 9/1977 McDanolds ..... F42B 33/06 102/293
4,316,404 A * 2/1982 Medlin ..... F41H 7/044 52/171.2
4,353,283 A * 10/1982 Crepin ..... F41A 27/10 89/41.11

(Continued)

*Primary Examiner* — Michael D David

(74) *Attorney, Agent, or Firm* — Ryan W. Dupuis; Kyle R. Satterthwaite; Ade & Company Inc.

(57) ABSTRACT

A cannister deployment apparatus for discharge of gas cannisters within a target building includes a battering ram arranged for being carried on a vehicle for penetrating into the building when impacted on the building by the vehicle. The battering ram has a housing with a plurality of receptacles for receiving the cannisters to be discharged respectively therein. The receptacles include (i) one or more release receptacles arranged to release the respective cannister from the release receptacle upon actuation by a release actuator so that the cannister is discharged from the housing, and (ii) one or more discharge receptacles enabling actuation of the respective cannister into an active state while the cannister remains supported within the discharge receptacle upon actuation by a discharge actuator arranged to trigger a release lever of the cannister in the discharge receptacle into an active state.

15 Claims, 3 Drawing Sheets

(56) References Cited

U.S. PATENT DOCUMENTS

| | | | | | |
|---|---|---|---|---|---|
| 4,485,877 | A * | 12/1984 | McMillan | B05B 1/02 | 169/48 |
| 4,598,096 | A * | 7/1986 | Grant | F42B 12/50 | 102/512 |
| 4,676,319 | A * | 6/1987 | Cuthbertson | A62C 31/22 | 239/271 |
| 5,105,716 | A * | 4/1992 | Hahn | F41A 27/10 | 89/36.13 |
| 5,140,891 | A * | 8/1992 | Husseiny | F42B 33/06 | 89/1.13 |
| 5,373,427 | A * | 12/1994 | McLean | F21V 33/0064 | 222/113 |
| 6,581,521 | B1 * | 6/2003 | Dixon | F42B 27/08 | 102/370 |
| RE38,247 | E * | 9/2003 | Wickser, Jr. | F41A 29/02 | 42/95 |
| 6,860,052 | B1 | 3/2005 | Conner | | |
| 7,305,788 | B1 * | 12/2007 | McLain | F42B 12/36 | 42/105 |
| 7,325,495 | B1 * | 2/2008 | Giandomenico | F41H 9/10 | 102/370 |
| 2002/0162852 | A1 * | 11/2002 | Cellini | F41H 9/10 | 222/402.11 |
| 2004/0188471 | A1 * | 9/2004 | Cellini | F41H 9/10 | 222/192 |
| 2010/0089226 | A1 * | 4/2010 | Jones | F42B 39/26 | 89/1.1 |
| 2012/0138319 | A1 * | 6/2012 | Demmitt | A62C 3/00 | 169/28 |
| 2019/0009975 | A1 * | 1/2019 | Herr | F42B 12/46 | |

* cited by examiner

BATTERING RAM WITH CANISTER DEPLOYMENT

This application claims foreign priority benefits from Canadian Patent Application 3,117,280 filed May 5, 2021.

FIELD OF THE INVENTION

This invention relates to a battering ram for penetration through a boundary barrier of a building, for example a door, window or wall, in which the battering ram includes a gas canister incorporated into the battering ram for discharging contents of the gas canister into the penetrated building.

BACKGROUND

Gas canisters that disperse irritants, for example lachrymator agents such as tear gas and the like, are known to be used by various law enforcement personal as a means to partially incapacitate or force compliance upon a potential assailant.

A gas canister typically includes a housing with a gas chamber for containing gas under pressure therein and a discharge valve through which the gas can be discharged from the chamber. One type of canister has a release lever that controls the valve between closed and open positions by pivoting of the release lever from an inactive position alongside the housing corresponding to the valve being closes to an active position protruding outwardly from the housing. A safety pin is typically received through cooperating apertures in the release lever and a corresponding portion of the housing to retain the release lever in the inactive position despite being commonly biased to the latched position in this instance.

In order to minimize any risk to persons activating a gas canister, it is known to eject gas canisters from a considerable distance by use of an air cannon type device.

In other instances, as described in U.S. Pat. No. 6,860,052 by Conner, a teargas deploying assembly may include an elongate tubular member mountable on a vehicle and adapted for puncturing through a boundary barrier of a building. The elongate tubular member must be further adapted to convey gas therethrough from a canister supported at the vehicle end of the elongate tubular member to discharge openings at the distal end of the elongate tubular member and is only capable of discharging contents from a single canister.

SUMMARY OF THE INVENTION

According to one aspect of the present invention there is provide an apparatus for discharge of canisters within a target building using an elongate member carried on a vehicle, the apparatus comprising:

a battering ram arranged for mounting onto the elongate member carried by the vehicle and arranged for penetrating into the building when impacted on the building by the vehicle;

the battering ram having a housing having a plurality of receptacles for receiving the canisters to be discharged respectively therein; and an actuator assembly operable remotely by a user in the vehicle for actuating discharge of at least a selected one of the canisters.

Preferably at least one of the receptacles is a release receptacle arranged to release the respective canister from the release receptacle upon actuation by a release actuator of the actuator assembly so that the canister is discharged from the housing.

One or more of the receptacles may also take the form of a discharge receptacle enabling actuation of the respective canister into an active state while the canister remains supported within the discharge receptacle. In this instance, the actuator assembly includes a discharge actuator arranged to trigger a release lever of the canister in the discharge receptacle into an active state.

By locating the canisters in a battery ram having a housing that both supports the canisters therein and that is arranged for penetration into a building, the canisters can be directly discharged into the building by releasing the canister from the housing into the building or discharging gas from a canister within a portion of the housing penetrated into the building for more direct discharge of gas from the canisters into the building that prior art arrangements.

In the instance of a release receptacle that releases a canister therefrom, the release receptacle is preferably arranged to hold a release lever of the respective canister in an inactive state while the canister remains supported within the release receptacle such that the release lever is arranged to be displaced from the inactive state to the active state upon discharging of the canister from the release receptacle in the housing. The release receptacle may include a biasing member associated therewith urging the respective canister to be ejected from the release receptacle upon actuation by the actuator assembly. The release receptacle is preferably arranged to discharge the respective canister from the housing through a bottom of the housing. When the lease receptacle is arranged to discharge the canister from a release opening in the housing, the actuator assembly preferably includes a release gate operatively associated with the release opening to control the release of the respective canister from the release receptacle. A single release gate may be operatively associated with more than one or all of the release receptacles. More particularly, the release gate may be arranged to (i) release the canisters from two of the release receptacles simultaneously with one another as the release gate is displaced from a closed position to an open position, and/or (ii) release the canisters from at least two of the release receptacles sequentially with one another as the release gate is displaced from a closed position to an open position.

In the instance of a discharge receptacle that discharges a canister retained therein, a plurality of discharge openings are preferably located in a bottom of the housing in communication with said at least one discharge receptacle such that the discharge receptacle is arranged to receive discharged contents of the canister therethrough upon triggering of the canister into the active state.

When both release receptacles that release canisters from the housing and discharge receptacles that discharge canisters retained therein are provided within the apparatus, preferably the release actuator for actuating the release of canisters from the release receptacles and the discharge actuator for actuating the discharge of canisters in the discharge receptacles are actuatable independently of one another.

When the battering ram extends in a forward direction from a rear end arranged for mounting on the vehicle to a forward end arranged for penetrating into the building, the discharge receptacle(s) are preferably located forwardly of the release receptacle(s).

Preferably each receptacle is arranged to receive its canister loaded therein through a loading opening at a top of the housing. In this instance, the apparatus preferably further comprises a lid operable relative to the loading opening between a closed position covering the loading opening and an open position in which the loading opening is substantially unobstructed by the lid.

When the battering ram has a forward end arranged for penetrating into the building, preferably the forward end includes a push plate oriented perpendicularly to a longitudinal direction of the elongate member, the push plate having a prescribed height exceeding a corresponding height of the housing of the battering ram and a prescribed width exceeding a corresponding width of the housing of the battering ram.

BRIEF DESCRIPTION OF THE DRAWINGS

Embodiments of the invention will now be described in conjunction with the accompanying drawings in which.

In the drawings like characters of reference indicate corresponding parts in the different figures.

DETAILED DESCRIPTION

Figure 1:
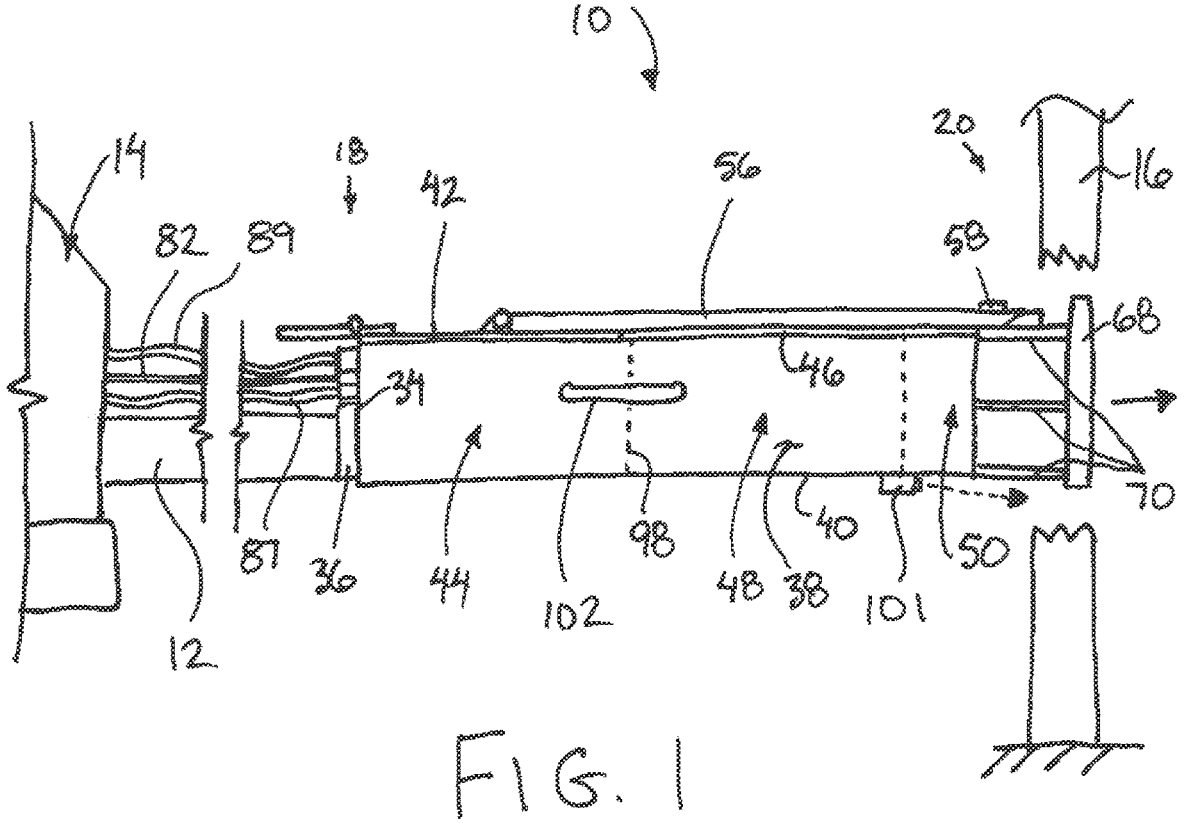
FIG. 1 is a side view of the gas canister discharging apparatus carried on an elongate member on a vehicle for penetration into a building.

Referring to the accompanying figures, there is illustrated a gas canister discharging apparatus generally indicating by reference numeral 10.

The apparatus 10 is particularly suited for mounting on an elongate member 12 carried on a vehicle 14 to function as a battering ram arranged for penetration in a forward direction of the vehicle through an upright boundary 16 of a target building, for example an exterior window, door, or perimeter wall of the building. In the illustrated embodiment, the elongate member 12 is a rigid beam of the type that can be mounted in fixed relation to the frame of the vehicle to project forwardly from the front end of the vehicle so that it can function itself as a battering ram, or serve to support a battery ram apparatus 10 according to the present invention thereon.

The apparatus 10 is elongate in a forward or longitudinal direction from a rear end 18 adapted to be mounted in fixed and immovable relation onto the forward end of the elongate member to a front end 20 adapted for penetration through the boundary 16 of the target building when displaced in the forward direction together with the vehicle upon which it is supported.

The apparatus 10 is intended to be used with a gas canister 22, for example a teargas canister, that is arranged to store gas under pressure therein in an inactive state and discharge the gas from the canister into the surrounding environment when activated from the inactive state to the active state. The canister 22 typically includes a generally cylindrical housing and a release lever 24 pivotally coupled at a top end of the housing to extend downwardly alongside the housing in the inactive state. A safety pin 26 is inserted through the level and a corresponding portion of the housing to retain the release lever in the inactive state. A spring member (not shown) acts on the release lever to bias the release lever outwardly and away from the housing from the inactive state to the active state upon removal of the safety pin.

The apparatus 10 has a rigid metal housing 28 defining a battering ram arranged for penetration through the boundary 16 of the building and which spans substantially a full length of the apparatus from the rear end 18 to the front end 20 of the apparatus. A rear wall 34 spans the full height and width at the rear end of the housing in perpendicular relation to the longitudinal direction of the apparatus. A suitable mounting arrangement 36 is provided at the exterior of the rear wall for mounting the apparatus in fixed relation onto the forward end of the elongate member 12 such that the longitudinal direction of the apparatus is aligned with the elongate member to protrude forwardly from the vehicle. The mounting arrangement may comprise a variety of brackets with removable threaded fasteners to releasably attach the apparatus onto the elongate member 12, or a variety of permanent structures including welding and the like.

The housing further includes two side walls 38 which are parallel and spaced apart across the width of the housing relative to one another such that each side wall spans substantially the full height and the full length of the housing. A bottom wall 40 spans horizontally between the bottom edges of the two side walls while spanning substantially the full length of the housing from the rear wall 34 to the front end of the housing.

At the top side of the housing 28, a top rear panel 42 spans between the side walls at the rear end of the housing for enclosing a rear chamber 44 described in further detail below. The top rear panel 42 is secured to the remainder of the housing using threaded fasteners such that the top rear panel can be removed for periodic access to the rear chamber 44 for maintenance and like.

A top front panel 46 spans between the side walls forwardly of the top rear panel 42 to extend longitudinally from a rear edge abutted with the front edge of the top rear panel 42 to a front edge terminating at the front end of the housing. The top front panel spans over an intermediate chamber 48 within the interior of the housing and a front chamber 50 within the interior of the chamber at the front end so that the intermediate chamber spans between the rear chamber and the front chamber in the longitudinal direction of the housing.

The top front panel 46 includes a first top opening 52 formed therein which spans most of the width and the length of the intermediate chamber 48 therebelow, and a second top opening 54 formed therein which spans most of the width and the length of the front chamber 50 therebelow for accessing the respective chambers as described in further detail below.

A cover panel defining a lid 56 of the housing is pivotally coupled at an intermediate location onto the top rear panel 42 by a suitable hinge oriented laterally such that the lid extends forwardly across both the first top opening 52 and the second top opening 54 in a closed position of the lid. More particularly, in the closed position, the lid spans over top of the full width and length of both the intermediate chamber 48 and the front chamber 50 to fully enclose the chambers and protect the contents thereof during use as a battering ram for penetration through a boundary of the building. The lid can be pivoted from the closed position to an open position by displacing the lid upwardly and rearwardly about the hinge axis until the lid extends generally rearward from the hinge such that the top openings are fully unobstructed by the lid.

A latching assembly selectively secures the lid in the closed position. The latching assembly includes an external knob 58 supported on the top side of the lid 56 at the forward end thereof in the closed position. A pivot shaft 60 is connected to the knob and extends through the lid for supporting a latch 62 thereon at the interior of the lid in the closed position. The latch 62 is arranged for selective alignment with a catch 64 formed on the underside of the top front panel at the forward perimeter edge of the second top opening 54. In the closed position, manually rotating the knob 58 allows the latch 62 to be displaced from a latched position engaged below the catch 64 to resist opening of the lid to an unlatched position in which the latch 62 is displaced away from the catch 64 so as not to interfere with opening of the lid relative to the housing.

The front end of the housing is formed by two front walls 66 which extend forwardly and laterally inwardly towards one another from the forward edges of the side walls 38 of the housing respectively so as to be joined to one another at a forward apex spanning a full height of the housing.

In some embodiments, the tapered front walls 66 may form the front end of the housing adapted for piercing through the wall of a building; however, in the illustrated embodiment the front end of the housing is further adapted with a push plate 68 that is mounted perpendicularly to the longitudinal direction of the housing for pushing through the wall of a building.

The push plate 68 is a thick rigid plate having a height which exceeds the corresponding height of the housing to protrude both above the top of the housing and below the bottom of the housing, while also having a lateral width which exceeds the corresponding width of the housing to protrude outwardly beyond both sides of the housing. The push plate 68 can be joined directly to the apex of the front walls 66 by suitable welding or other fixed mounting structure in addition to being supported by a plurality of gusset plates 70. A plurality of the gusset plates 70 are provided at vertically spaced positions between each front wall 16 and the rear of the push plate 68 so as to be generally triangular in shape.

Within the interior of the housing 28, the rear chamber 44 generally houses various actuating components as described in further detail below. The intermediate chamber 48 defines six release receptacles 72 that are each arranged to receive a respective canister therein such that the canister is released from the housing for discharge of the gas therefrom as described in further detail below. Finally, the forward chamber 58 defines two discharge receptacles 74 that are each arranged to receive a respective canister therein such that the canister is retained within the housing while discharging of the gas therefrom as described in further detail below.

Within the forward discharge chamber 58, the two discharge receptacles 74 are located laterally beside one another. A horizontal mounting plate 76 is supported within the front chamber 50 with a pair of circular holes formed therein which define the two receptacles 74 respectively. The mounting plate 76 is located in close proximity to the bottom of the housing while being spaced thereabove to receive only the lower portion of the canister therein in a manner that results in the release lever remaining supported above the mounting plate 76 so that the mounting plate 76 defining the two receptacles 74 therein does not interfere with displacement of the release lever of the canister from an inactive position to the active position thereof.

A plurality of discharge openings 78 are formed in the bottom wall of the housing in communication with the front chamber such that any gas discharged from the canisters within the front chamber can be readily communicated downwardly through the discharge openings 78 to the exterior of the housing while the canisters remain supported within the discharge receptacles 74 respectively. Locating the discharge openings 78 in the bottom side of the housing ensures that the housing is protected from possible debris entering the housing through the discharge openings when penetrating the battering ram through the boundary of the building for example.

An actuating assembly is provided for actuating the discharge of gas from the canisters and includes a discharge actuator 80 associated with each of the discharge receptacles 74. The discharge actuator 80 includes an actuating cable 82 that is mounted within a supporting sleeve to communicate from a first end of the cable securable to the safety pin 26 of the canister within a respective discharge receptacle 74 to a second end of the cable supported within the rear chamber 44 of the housing.

Figure 2:
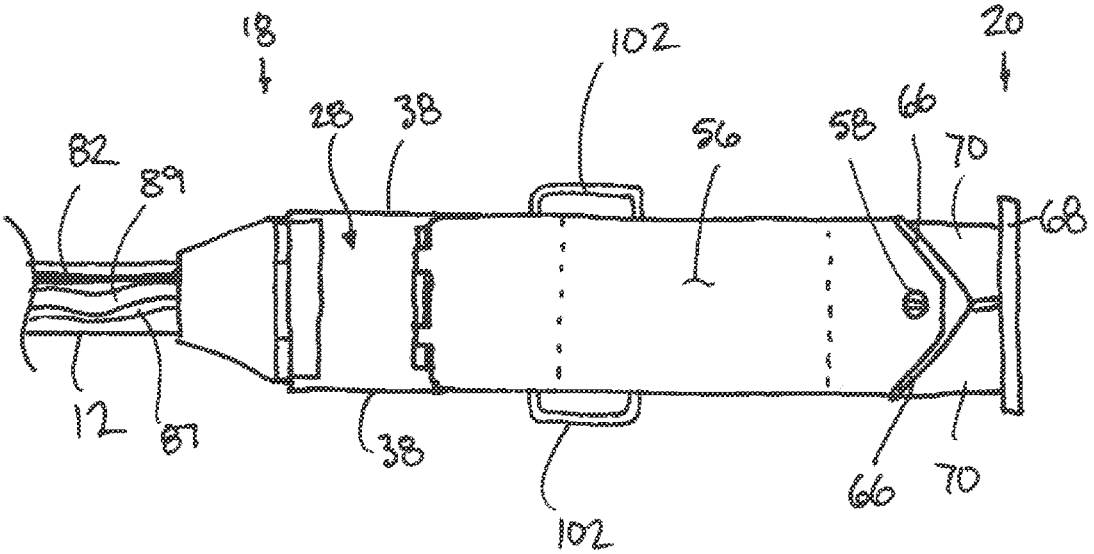
FIG. 2 is a top view of the apparatus according to FIG. 1 in which a lid of the apparatus is shown in a closed position.
Figure 3:
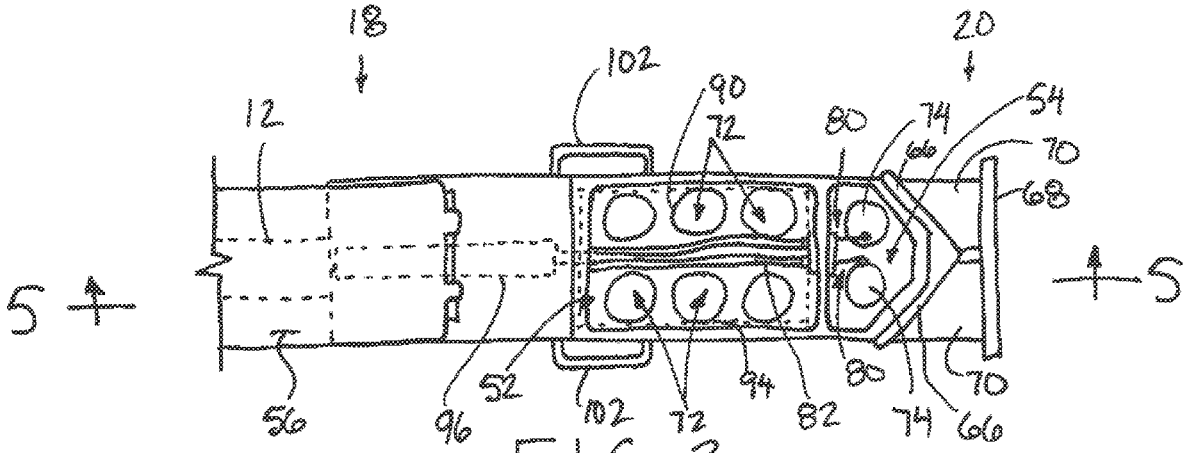
FIG. 3 is a top view of the apparatus according to FIG. 1 in which the lid is shown in an open position.
Figure 4:
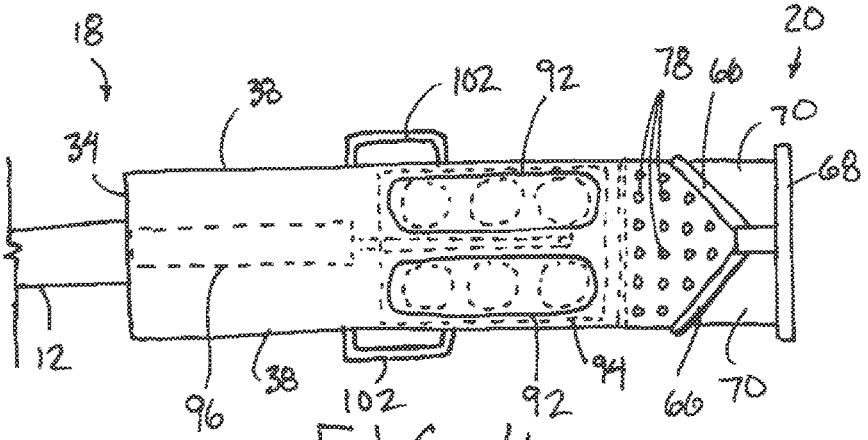
FIG. 4 is a bottom view of the apparatus according to FIG. 1.

In a manually actuated alternative as shown in FIGS. 1 and 2, the cables 82 may continue externally of the housing through the rear of the housing to reach an operator within the vehicle so that manually pulling on the cable from the vehicle can serve to pull the pin from the canister of the associated discharge receptacles 74. Due to the release lever of the canister being biased to an active position and the non-interfering relationship of the discharge receptacle with the canister, removing the safety pin 26 causes the canister to automatically be displaced to an active state opening the valve for discharge of gas from the canister.

Figure 5:
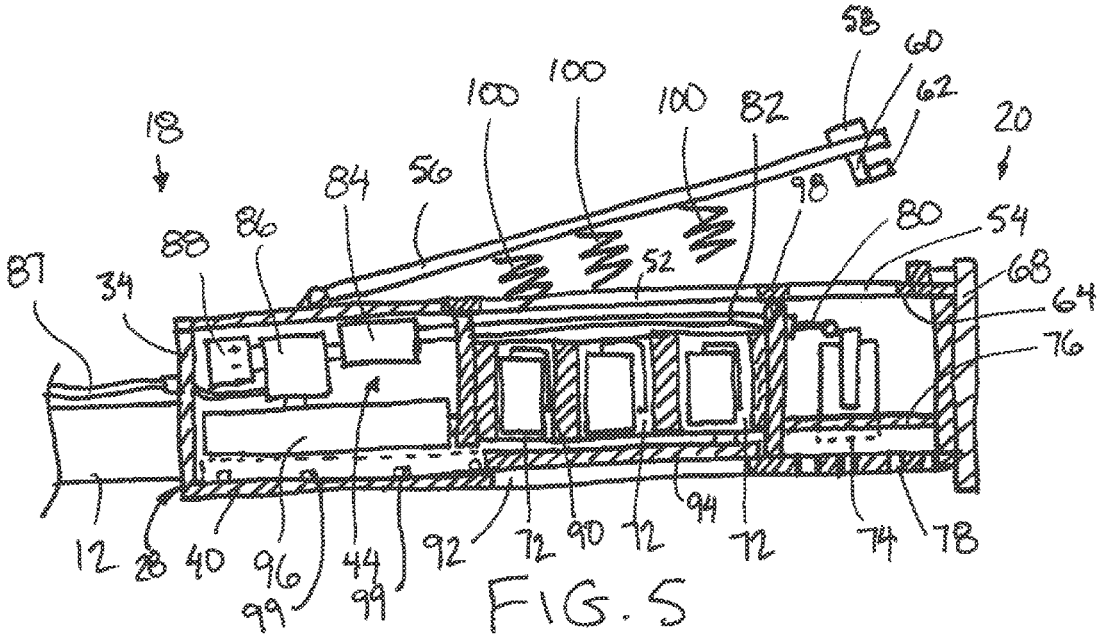
FIG. 5 is a sectional view of the apparatus along the line 5-5 in FIG. 3.
Figure 6:
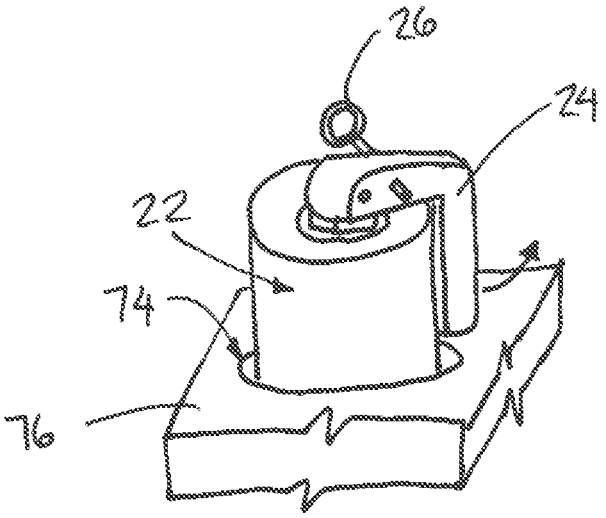
FIG. 6 is a perspective view of a gas canister supported within one of the discharge receptacles of the apparatus.
Figure 7:
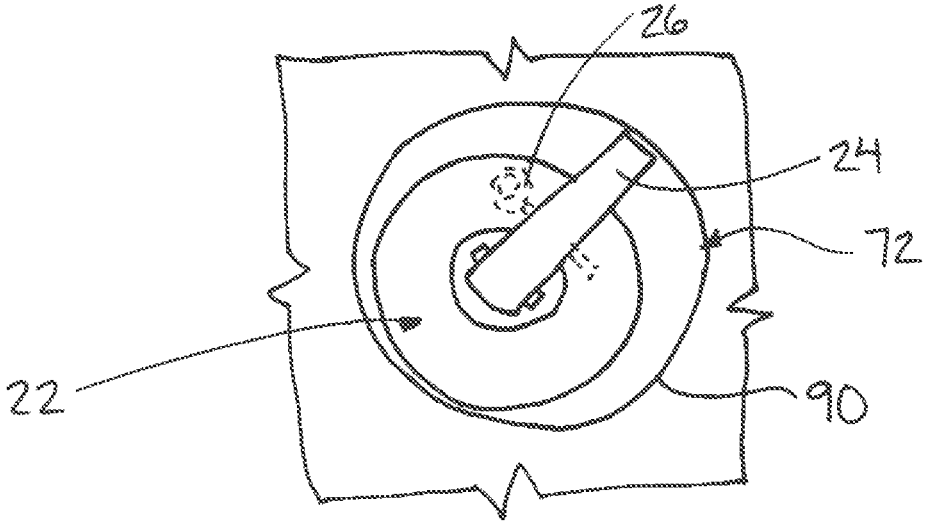
FIG. 7 is a top view of a gas canister supported in one of the release receptacles of the apparatus.

In a remote actuated alternative as shown in FIG. 5, the second end of the cable 82 within the rear chamber 44 can be connected with a discharge actuator motor 84 which serves to pull the cable 82 to release the safety pin when a suitable actuator signal is received from a controller 86 also mounted within the rear chamber 44.

The controller 86 may be configured to receive instructions in the form of wired signals through a transmission cable 87 connected to a wired remote in the vehicle or wireless signals transmitted from a wireless remote unit in the vehicle to a receiver of the controller. In this instance, a user actuates the remote unit in the vehicle to generate a wireless actuation signal received by the controller which in turn responds by generating a suitable actuator signal for the discharge actuator motor 84 that pulls the cable to release the safety pin from the canister.

The electronic components within the chamber 44 may be powered by a battery 88 within the rear chamber as shown in FIG. 5.

Alternatively, as shown in FIGS. 1 and 2, electrical power may be delivered to the components within the rear chamber including the controller 86 using a power cable 89 that receives power from the electrical systems of the vehicle.

Within the intermediate release chamber 48 the release receptacles 72 are arranged in two longitudinally extending columns of three receptacles per column. The columns are laterally beside one another to form three laterally extending rows of receptacles in which two release receptacles 72 are laterally beside one another within each row.

Each release receptacles 72 comprises a suitable sleeve 90 that is upright in orientation and has a suitable height to span substantially the full height of a respective canister received therein. The interior diameter of the sleeve is arranged to circumscribe the housing and the release lever in the inactive state of the respective canister such that the surrounding structure of the sleeve 90 is sufficient to retain the release lever in the inactive position even when the safety pin 26 is removed from the canister. In addition to each release receptacle supporting the respective canister therein to retain the canister in the inactive position, the receptacle also receives the canister therein such that it is freely vertically slidable within the receptacle.

Two release openings 92 are formed in the bottom wall of the housing in alignment with the release receptacles 72 to allow the canisters to be released downwardly through the bottom of the housing through the release openings when the release openings are opened. Each release opening 92 is elongated in shape to fully span all three release receptacles 72 of a respective column such that the two release openings are elongate in the longitudinal direction and laterally beside one another.

To control the release of the canisters from the release receptacles, the actuating assembly includes a release actuator in the form of a release gate 94 and a gate actuator 96 that controls the positioning of the release gate. The release gate is a flat panel having a length corresponding to the length of the release openings and a width that is near the width of the housing to span laterally across both release openings in the closed position. The panel forming the release gate 94 is supported for longitudinal sliding movement within the interior of the housing directly above the bottom wall from a closed position occupying the bottom of the intermediate chamber 48 to cover all of the release openings 92 to a fully open position displaced rearwardly so as to be located substantially within the rear chamber 44 such that the release openings and thus the bottom ends of the release receptacles are fully unobstructed by the release gate.

The gate actuator 96 may comprise any suitable linear actuator which is motorized and actuatable by a suitable actuating signal from the controller 86 in response to receipt of a suitable wired or wireless activation signal from the remote unit in the vehicle. The gate actuator 96 can be supported within the rear chamber to communicate through a first intermediate wall 98 separating the rear chamber from the intermediate chamber. A set of four microswitch sensors 99 are actuated by the different positions of the release gate corresponding to a fully closed position, a first intermediate position in which two receptacles 72 are open, a second intermediate position in which four receptacles 72 are open, and a fully open position in which all receptacles 72 are open. The sensors 99 provide feedback to the controller so that the controller can determine the operating position of the gate and appropriate actuate the actuator 96 to position the gate 94 in the desired position.

In the instance of a first intermediate wall 98 located within the interior of the housing, the bottom edge of the first intermediate wall is spaced above the bottom wall of the housing, similarly to the bottom ends of the sleeves 90 of the receptacles, to provide a clearance gap receiving the release gate therethrough as the release gate is displaced between the open and closed positions.

The gate actuator can be controllably displaced from the fully closed position to the fully open position in addition to locating the release gate in either one of a first intermediate position in which only the two forwardmost release receptacles 72 are unobstructed by the release gate or a second intermediate position in which the four forwardmost release receptacles 72 are unobstructed by the release gate. Displacing the gate actuator from the fully closed position to the first intermediate position results in the two forwardmost release receptacles being opened simultaneously so that the corresponding canisters within those receptacles are released simultaneously from the housing. Continued displacement of the gate actuator towards the fully open position will allow subsequent rows of canisters to be released from the housing sequentially with one another.

To assist in the canisters within the release receptacles in being released from the housing when the bottom of the release receptacle is open to the exterior, a release spring 100 is mounted to the bottom side of the lid 56 in alignment with each of the release receptacles 72. Each release spring 100 is a helical spring mounted under compression between the lid and the top side of a canister mounted within the respective release receptacle 72 such that upon opening of the bottom side of the release receptacle by displacement of the release gate 94 towards the open position, the downward force applied to the canister by the release spring 100 overcomes any possible friction between the canister and the surrounding walls of the sleeve 90 of the release receptacle to ensure the release receptacle discharges the canister from the housing when opened. Once the canister has been released from the housing, and the release receptacle no longer functions to retain the release lever of the canister in the inactive position, the normal biasing of the release lever of the canister will cause the canister to be automatically displaced into the active state for opening the valve and discharging gas from the canister.

The apparatus may further include a camera 101 arranged to be supported on a bottom side of the housing of the apparatus as shown in FIG. 1. The camera is supported such that the lens of the camera is directed forwardly to capture video images. When the camera is positioned in a shielded arrangement between the path of the bottom edge of the forward push plate 68, the lens may be directed forwardly at a slight downward slope to capture images below the push plate 68. The camera 101 communicates with the controller 86 which stores the images and/or relays the images to a remote device for subsequent storage and viewing of the video images. The camera 101 is preferably an infrared camera with its own infrared light source and an ability to capture infrared video images so that the camera remains effective in the absence of visible light. A microphone is associated with the camera 101 to also capture audio content with the video images.

The apparatus is intended to be mounted onto the elongate member 12 of a vehicle 14 for use of the elongate member as a battering ram. The apparatus in this instance itself forms the forward end of the battering ram such that the housing of the apparatus itself is intended to be penetrated through the boundary of the building for subsequent discharge of gas from the canisters within the housing into the interior of the building. A pair of handles 102 are provided at laterally opposing sides of the housing to protrude from the side walls 38 of the housing respectively to assist in handling of the apparatus when mounting onto the vehicle.

Once mounted on a vehicle, gas canisters can be loaded into the housing by opening of the lid 56. The operator manually removes the safety pin from each of the gas canisters supported within the release receptacles 72 within the intermediate chamber of the housing so as to rely on the release receptacles surrounding the canisters to retain the canisters in the inactive state until the canisters are released from the bottom of the housing as described above. The actuator cables 82 of the discharge actuators 80 are further connected to the safety pins of the two canisters supported within the two discharge receptacles 74 in the front chamber 50 respectively to further arm the apparatus.

When deploying the apparatus 10, the vehicle is used to navigate the apparatus 10 for penetration through the boundary of the building. To effectively discharge the contents of the canisters within the interior of the building, at least the front chamber 50 and the intermediate chamber 48 of the housing are penetrated into the building beyond the perimeter exterior boundary of the building.

Actuation of the discharge actuators 80 through remote or manual means causes the actuator cables 82 to pull the safety pins of the canisters in the forward discharge receptacles 74 so that the canisters can be automatically actuated into the active state for discharge of gas therefrom while the canisters remain supported within the front chamber. The discharge actuators 80 can be actuated independently of one another for discharging gas selectively from either one or both of the canisters in the forward discharge receptacles 74.

Actuation of the release gate actuator 96 causes the release gate 94 to be controllably displaced from the closed position to either one of the first intermediate position, the second intermediate position or the fully open position to sequentially release simultaneous pairs of canisters from the release receptacles 72 of the housing. The release springs 100 assist in urging the canisters within the release receptacles to be quickly released from the housing upon opening the bottom of the release receptacles so that the release levers of the canisters can be automatically biased to their active state for releasing gas from the canisters.

The independent control of the release actuator and the discharge actuators provide the operator with a great degree of control over the manner of gas discharge from either canisters retained in the housing or canisters released from the housing as well as a great degree of control over the number of canisters and overall amount of gas to be discharged into the building.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. An apparatus for discharge of gas canisters within a target building using an elongate member carried on a vehicle, the apparatus comprising:

a battering ram extending in a forward direction from a rear end arranged to be mounted onto the elongate member carried by the vehicle to a front end arranged for penetrating into the building when impacted on the building by the vehicle;

the battering ram having a housing having a plurality of receptacles for receiving the canisters to be discharged respectively therein; and an actuator assembly operable remotely by a user in the vehicle for actuating discharge of at least a selected one of the canisters;

wherein at least one of the receptacles is a release receptacle operatively associated with a release actuator of the actuator assembly; and wherein in response to actuation by the release actuator, the release receptacle is arranged to (i) eject the respective canister from the housing of the battering ram and (ii) actuate the respective canister into an active state to discharge gas from the gas canister when the canister is ejected from the housing of the battering ram.

2. The apparatus according to claim 1 wherein said at least one release receptacle is arranged to hold a release lever of the respective canister in an inactive state while the canister remains supported within the release receptacle such that the release lever is arranged to be displaced from the inactive state to the active state upon ejection of the canister from the housing.

3. The apparatus according to claim 1 wherein said at least one release receptacle includes a biasing member associated therewith urging the respective canister to be ejected from the release receptacle upon actuation by the actuator assembly.

4. The apparatus according to claim 1 wherein said at least one release receptacle is arranged to eject the respective canister from the housing through a bottom of the housing.

5. The apparatus according to claim 1 wherein said at least one release receptacle is arranged to eject the respective canister from a release opening in the housing and wherein the actuator assembly includes a release gate operatively associated with the release opening to control the ejection of the respective canister from the release receptacle.

6. The apparatus according to claim 5 wherein more than one of the receptacles comprise release receptacles and wherein the release gate is operatively associated with all of the release receptacles.

7. The apparatus according to claim 6 wherein the release gate is arranged to release the canisters from two of the release receptacles simultaneously with one another as the release gate is displaced from a closed position to an open position.

8. The apparatus according to claim 6 wherein the release gate is arranged to release the canisters from at least two of the release receptacles sequentially with one another as the release gate is displaced from a closed position to an open position.

9. The apparatus according to claim 1 wherein at least one of the receptacles is a discharge receptacle enabling actuation of the respective canister into an active state to discharge gas from the gas canister while the canister remains supported within the discharge receptacle, and wherein the actuator assembly includes a discharge actuator arranged to trigger a release lever of the canister in the discharge receptacle into an active state.

10. The apparatus according to claim 9 further comprising a plurality of discharge openings in a bottom of the housing in communication with said at least one discharge receptacle such that the discharge receptacle is arranged to receive the gas discharged from the canister therethrough upon triggering of the canister into the active state.

11. The apparatus according to claim 9 wherein the release actuator and the discharge actuator are actuatable independently of one another.

12. The apparatus according to claim 9 wherein the battering ram extends in a forward direction from a rear end arranged for mounting on the vehicle to a forward end arranged for penetrating into the building, said at least one discharge receptacle being located forwardly of said at least one release receptacle.

13. The apparatus according to claim 1 wherein each receptacle is arranged to receive its canister loaded therein through a loading opening at a top of the housing, and wherein the apparatus further comprises a lid operable relative to the loading opening between a closed position covering the loading opening and an open position in which the loading opening is substantially unobstructed by the lid.

14. The apparatus according to claim 1 wherein the front end of the battering ram comprises a push plate oriented perpendicularly to a longitudinal direction of the elongate member, the push plate having a prescribed height exceeding a corresponding height of the housing of the battering ram and a prescribed width exceeding a corresponding width of the housing of the battering ram.

15. The apparatus according to claim 1 further comprising a camera supported on the housing and having a lens directed forwardly so as to be arranged to capture infrared video images.

* * * * *